US006588641B2

(12) United States Patent
Prittie

(10) Patent No.: US 6,588,641 B2
(45) **Date of Patent: *Jul. 8, 2003**

(54) METHOD AND APPARATUS FOR HANDLING WEB

(75) Inventor: Allan R. Prittie, Toronto (CA)

(73) Assignee: Prittie Family Trust 1989, Etobicoke (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/919,609

(22) Filed: Aug. 1, 2001

(65) Prior Publication Data

US 2002/0148876 A1 Oct. 17, 2002

Related U.S. Application Data

(63) Continuation-in-part of application No. 09/832,300, filed on Apr. 11, 2001.

(51) Int. Cl.[7] ..... B65H 20/24; B65H 20/34

(52) U.S. Cl. ..... 226/118.3; 226/117; 226/172

(58) Field of Search ..... 226/118.3, 118.2, 226/117, 44, 172; 242/418.1

(56) References Cited

U.S. PATENT DOCUMENTS

| | | | | | |
|---|---|---|---|---|---|
| 2,758,541 | A | | 8/1956 | Tison | |
| 2,998,175 | A | * | 8/1961 | Topping | 226/118.3 X |
| 4,009,814 | A | | 3/1977 | Singh | |
| 4,011,976 | A | * | 3/1977 | Greer | 226/117 X |
| 4,356,946 | A | | 11/1982 | Gaskell | |
| 4,787,544 | A | * | 11/1988 | Jones | 226/118.3 |
| 5,480,085 | A | * | 1/1996 | Smithe et al. | 226/44 |
| 5,597,105 | A | * | 1/1997 | Keller | 226/118.3 |
| 5,810,236 | A | * | 9/1998 | Yoshida et al. | 226/118.3 |
| 5,964,392 | A | * | 10/1999 | Long, Jr. | 226/117 X |

* cited by examiner

*Primary Examiner*—Kathy Matecki
*Assistant Examiner*—Minh-Chau Pham
(74) *Attorney, Agent, or Firm*—Shoemaker and Mattare

(57) ABSTRACT

For use in a web-handling apparatus, a cylinder module accumulates and de-accumulates web in a controlled manner. A frame supports first and second parallel main cylinders. The first cylinder rotates continuously, while the second cylinder operates in a non-uniform manner. A third main cylinder remains parallel with the first and second axes while moving perpendicular to those axes. The web passes around the first cylinder through the first nip, thence to and around the periphery of the third cylinder, thence to and partially around the periphery of the second cylinder and through the second nip. The web spans from the third cylinder are substantially parallel. An endless belt associated with each end of the third cylinder ensures that the third cylinder occupies an axis location and a rotational position which substantially control the web stress as the web passes through the cylinders.

5 Claims, 4 Drawing Sheets

METHOD AND APPARATUS FOR HANDLING WEB

CROSS-REFERENCE TO RELATED APPLICATION

This is a continuation-in-part of U.S. patent application Ser. No. 09/832,300, filed on Apr. 11, 2001, in the name of Allan R. Prittie.

FIELD OF THE INVENTION

This invention relates to an apparatus and method for handling web in such a way as to minimize web transport inertia and consequent unwanted variations in web elongation.

PRIOR ART

The nature of the prior art over which the present invention represents an improvement is exemplified by U.S. Pat. No. 2,758,541, Tison.

In the Tison patent, a reciprocating motion is superimposed upon the otherwise continuous movement of the web from an unwind station to a rewind station (or other downstream operation). The result is to synchronize web movement with printing elements supported on base rollers which have a larger periphery than the minimum necessary to accommodate the circumferential extent of the printing and support elements. When the latter printing and support elements come around again to carry out their operation, the superimposed motion factor ensures that the web movement and position correspond to those of the printing and support elements.

To achieve this matching of speed and position, Tison provides a transport carriage which is directly driven intermittently parallel to the general direction of web movement, the latter's continuous velocity being determined by the activity of draw cylinders. For example, immediately after the printing and support elements complete their contact with the web, the transport carriage slows down, then is driven through zero speed, then is retracted in the opposite direction in order to reset the position of the web vis a vis the printing and support elements on the next pass.

The type of mechanism just described is in general use. For example, it is utilized to do intermittent flat die cutting by moving the roller transport carriage in such a way as to stop the web for cutting.

Unfortunately, this design is severely limited in its registration accuracy, i.e., the accuracy that can be achieved in the stepping of the web in synchronism with rotation of the base cylinders, especially as running speeds and indexing rates are increased.

Because of the mechanical inertia of the carriage and the rollers it supports (linear inertia) and the rotational inertia of the rollers about which the web is entrained, registration accuracy tends to be poor, even at low indexing speeds (up to 30 or 40 indexes per minute). It is certainly not practical in the present day, since high accuracy is required from zero up to over 200 indexes per minute.

The fact that the carriage-mounted rollers must be accelerated and decelerated as the carriage moves through its cycle causes tension variations to be imparted to the web by virtue of the rollers' inertial effects on the web.

Attention is further drawn to U.S. Pat. No. 4,009,814, issued Mar. 1, 1977 to Singh and U.S. Pat. No. 4,356,946, issued Nov. 2, 1982 to Gaskell. Both of these patents utilize a very large intermediate carriage which transports a plurality of toothed wheels and is rigged for translational movement toward and away from headers above and below it, upon which are mounted stationary toothed wheels. An endless chain or the like is strung between the various toothed wheels in a boustrophedonic configuration (festooning). The chain, carriage and wheels are all driven from outside (i.e., there is no individual drive to the wheels involved in the "endless" configuration). As a result, the inertia that must be overcome from the outside is enormous. It consists of translational inertia in the carriage and the chain, translational inertial in the wheels, and rotational inertia in the wheels (i.e., resistance to a change in rotational speed).

GENERAL DESCRIPTION OF THIS INVENTION

In view of the shortcomings of the prior art, as set forth above, it is an object of one aspect of this invention to convert substantially continuous web motion, without objectionable tension fluctuations, into an intermittent motion, while ensuring that the web is in an accurate register position with respect to the elements (printing plates or die-cutting cylinders, for example) which are intended to carry out an operation on the web.

More particularly, this invention provides, for use in an apparatus for handling web, a cylinder module providing for the accumulation and de-accumulation of web at a controlled web strain and minimal inertia, the module comprising:

a frame, a first main cylinder mounted on the frame for rotation about a first axis fixed with respect to the frame, a first nip cylinder cooperating with the first main cylinder to form a first nip to grip the web, a first motor and controller adapted to drive the first main cylinder in a substantially continuous manner, a second main cylinder mounted on the frame for rotation about a second axis fixed with respect to the frame, the second axis being substantially parallel with the first axis, a second motor and controller adapted to drive the second main cylinder in a substantially non-uniform manner, a third main cylinder mounted for constrained rotation about a third axis which is and remains parallel with the first and second axes while undergoing movement in a direction perpendicular to said first and second axes, whereby the web can pass partially around the periphery of the first cylinder and through the first nip, thence to and partially around the periphery of the third cylinder, thence to and partially around the periphery of the second cylinder and through the second nip, the cylinders being disposed such that there is a straight web span from the third to the first cylinder which is substantially parallel to a straight web span from the third to the second cylinder, and endless belt means associated with each end of the third cylinder for ensuring that the third cylinder, from moment to moment, automatically takes up an axis location and a rotational position which substantially control the web stress as it passes through the cylinders.

This invention further provides a method of handling web, utilizing a cylinder module providing for the accumulation and de-accumulation of web at controlled web strain and minimal inertia, the module comprising:

a frame, a first main cylinder mounted on the frame for rotation about a first axis fixed with respect to the frame, a first nip cylinder cooperating with the first main cylinder to form a first nip to grip the web, a first motor and controller adapted to drive the first main cylinder in a substantially continuous manner, a second main cylinder mounted on the frame for rotation about a second axis fixed with respect to the frame, the second axis being substantially parallel with the first axis, a second nip cylinder cooperating with the second main cylinder to form a second nip to grip the web, a second motor and controller adapted to drive the second main cylinder in a substantially intermittent manner, a third main cylinder mounted for rotation about a third axis which is and remains parallel with the first and second axes while undergoing movement in a direction perpendicular to said first and second axes, said method comprising the steps:

passing the web partially around the periphery of the first cylinder and through the first nip, thence to and partially around the periphery of the third cylinder, thence to and partially around the periphery of the second cylinder and through the second nip, the cylinders being disposed such that the web span from the third to the first cylinder is substantially parallel to the web span from the third to the second cylinder, utilizing endless belt means associated with each end of the third cylinder for ensuring that the third cylinder, from moment to moment, automatically takes up an axis location and a rotational position which substantially relieve the web of stress as it passes through the cylinders.

said endless belt means comprising:

a carriage at either end of the third cylinder to which said third cylinder is mounted for rotation, and for each carriage a guideway means ensuring that the carriage undergoes substantially rectilinear movement along a pathway which generally bisects the span between the first and second cylinders, each carriage supporting a first toothed wheel for rotation adjacent the third cylinder, the two first toothed wheels being locked together for simultaneous rotation, the frame supporting, at opposed ends of the cylinders, two second toothed wheels for rotation on one side of the pathway and two third toothed wheels for rotation on the other side of the pathway, the two second toothed wheels being locked together for simultaneous rotation, and the two third toothed wheels also being locked together for simultaneous rotation, the first, second and third cylinders each having, at either end, a coaxial toothed wheel fixed to the respective cylinder, and, at each end of the cylinders, an endless toothed belt;

the method further comprising: entraining said endless toothed belt around the toothed wheel of the first cylinder, thence along a first path to and around the toothed wheel of the third cylinder, thence along a second path to and around the toothed wheel of the second cylinder, the first and second paths being parallel, thence along a third path to and around said second toothed wheel, thence along a fourth path to and around said first toothed wheel, thence along a fifth path to and around the third toothed wheel, the fourth and fifth path being substantially parallel to each other and to the first and second paths, thence along a sixth path which returns it to said toothed wheel of said first cylinder.

GENERAL DESCRIPTION OF THE DRAWINGS

One embodiment of this invention is illustrated in the accompanying drawings, in which like numerals denote like parts throughout the several views, and in which:

FIG. 1 is a schematic representation of the prior art arrangement utilized by Tison, U.S. Pat. No. 2,758,541;

DETAILED DESCRIPTION OF THE DRAWINGS

Figure 1:
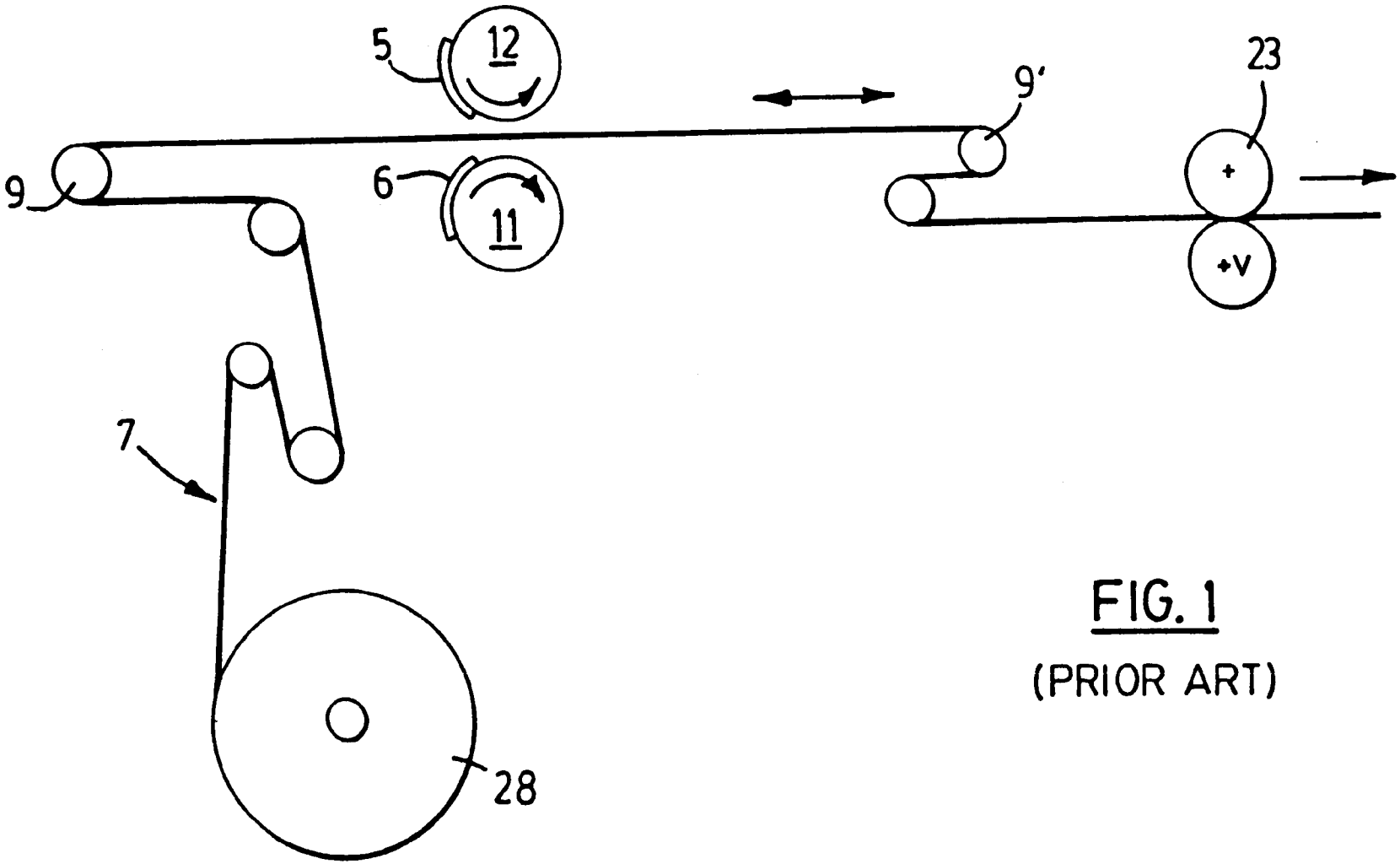
FIG. 1 (PRIOR ART)

Referring first to the prior art exemplified by the Tison U.S. Pat. No. 2,758,541 (FIG. 1), web 7 is payed off the unwind station 28 at a relatively continuous speed as governed by draw rollers 23.

A transport carriage (not illustrated in the diagram of FIG. 1) supports rollers 9 and 9' respectively upstream and downstream of the printing elements 5 and support element 6 mounted on the cylinders 12 and 11.

The transport carriage is driven intermittently to the right and to the left, in order to move the web 7 to the right when printing element 5 and support element 6 are coming into contact with the web 7. After the elements 5 and 6 have separated from the web 7, the transport carriage slows down in its rightward movement, is driven through zero speed, then retracts to the left. The motions of the transport carriage and the cylinders 12 and 11 are synchronized with the draw cylinders 23, so that the printing can be done in step fashion.

Rollers 11 and 12 are locked together rotationally and rotate continuously, synchronized with the motions of the carriage drive and the draw rollers 23.

As mentioned previously, the prior art design shown in FIG. 1 is severely limited in registration accuracy because of the mechanical translational inertia of the carriage and the rollers 9, 9' mounted thereon and because of the rotational inertia of the rollers 9, 9', since the latter must be accelerated and decelerated as the carriage moves through its cycle. This results in tension variations in the web due to the inertial effects.

CURRENT INDUSTRY REQUIREMENTS

In recent years, the printing and packaging industry has been faced with an extreme drive by end customers a) to dramatically reduce run length to achieve "as needed" quantities only, this being an extension of what has been referred to as "just in time" manufacturing;

b) to dramatically improve delivery times on such shorter runs;

c) while achieving the two objectives just mentioned, to improve graphic quality both in printing and in cutting/creasing;

d) to increase the number of inline operations available such as screen printing, embossing and carton windowing; and f) to achieve all of the above objectives at better pricing.

The foregoing requirements have driven the demand placed on machine designers to shorten job makeready time and to reduce job makeready waste, job run time, and job tooling costs.

The machines conventionally used in the recent past (for long and medium length runs) to achieve higher run speed have been those employing continuously moving print cylinders, embossing cylinders, cutting/creasing cylinders, etc. From job to job, since the image lengths vary, this has meant that different diameters of tooling cylinders—such as print cylinders, embossing cylinders, cutting cylinders, etc.—and their associated mounting hardware—have to be purchased (typically at high cost and extended lead time) and changed out while the press is stopped in makeready condition.

These requirements add considerable cost to any particular job.

It is known that intermittent feeding of web through either continuously moving elements or intermittently moving elements (such as print systems and intermittent cutting and creasing systems) will lower tooling costs but will also dramatically lower the throughput rate and therefore increase the job cost.

The present invention offers a system that will take a web continuously from a continuously moving process, such as unwinding or preprinting. It is important to take this web continuously under measured and controlled tension.

The continuously moving web is then converted, at high indexing rates (to achieve high throughput rates) and high registration accuracy (using low inertia means), to achieve high print/graphic quality.

The present design also allows for severing of the web if individual parts are required to be delivered. It also permits the re-conversion of the intermittent motion back to continuous motion for rewinding or further continuous rotary processing.

Figure 2:
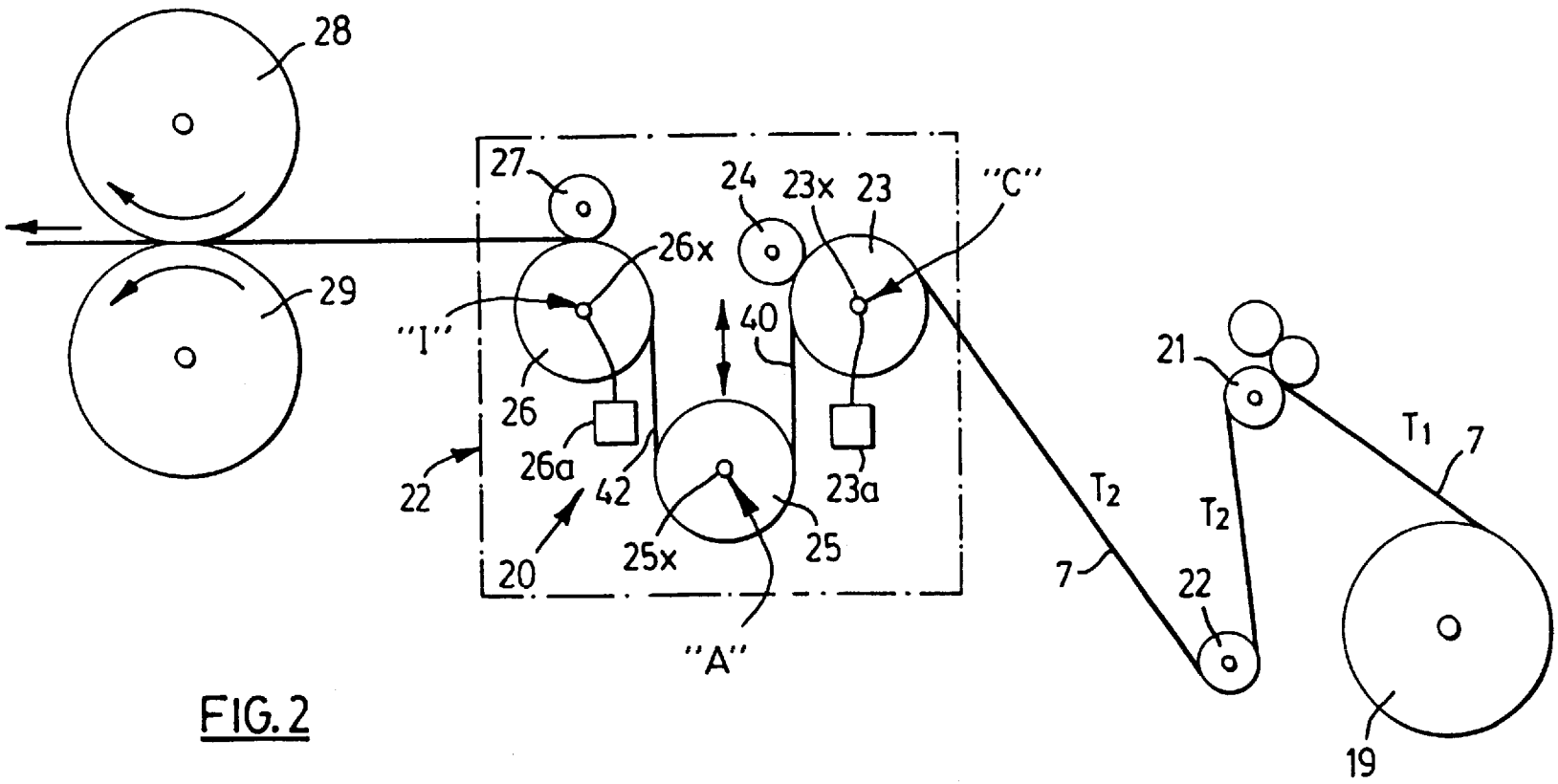
FIG. 2 is a schematic representation of the arrangement constituting the present invention.

In FIG. 2, a cylinder module 20 is contained within a broken line 22.

The cylinder module 20 is intended for use with an apparatus that handles web. In FIG. 2, the web-handling apparatus includes (by way of example only) an unwind roll 19 which feeds web at tension $T_1$ to and around a roller 21 which can be considered to be a feed cylinder, or a base driven roller of a coating system or a printing system (examples only). From the roller 21, the web 7 passes around an idler 22 and then goes to the cylinder module 20. The idler 22 can be provided with a load cell which will measure, by reference, tension in the web from cylinder 21 to cylinder 23. Cylinder 23 is driven by a motor 23*a* and can be referred to as the "C" axis (continuous axis). The control for driving cylinder 23 and its associated nip roller 24 comes by electronic reference which tells the drive axis controller (part of motor drive system 23*a*) the speed of the feeding system and the web tension T2.

Cylinder 26 and the associated nip roll 27 are intermittently driven by a motor drive system 26*a*. The cylinder 26 can be considered to define the "I" axis (intermittent). The indexing rate of the "I" axis must be carefully synchronized with downstream requirements, which in the illustrated example embodiment relates to the motion of processing cylinders 28 and 29 which are moving continuously. Other possible downstream requirements could involve a flat die cutting process.

Roller 25 can be regarded as defining an accumulating axis, or "A" axis. Its function is to accumulate and de-accumulate web considering the motion of the cylinders 23 and 26. Roller 25 is driven vertically as a result of the motion from the continuous cylinder 23 superimposed upon the motion from the intermittent cylinder 26. This is accomplished by utilizing belts, which will be described further below, and which interconnect the cylinders 23, 25 and 26 (as well as other portions of the apparatus).

It is regarded as novel to be able to accurately drive the rotation of the cylinder 25, while vertically accumulating and de-accumulating web—by interactive reference to the motions of the cylinders defining the "C" and "I" axes—between the continuously moving draw roll/nip roll combination 23, 24, while intermittently moving the intermittent axis (draw roll 26 and nip roll 27). In other words, the rotational and translational motion of the roller 25 is determined by the rotational and indexing actions of the axes "C" and "I", and not by direct motive power. This is one factor which contributes to keeping the inertia of the "A" axis (defined by the cylinder 25) as low as possible.

It is also considered important to drive cylinder 25 using a separate rotational speed controlling means, rather than driving it rotationally (accelerating and decelerating) by using the web. This avoids the risk that the cylinder 25 will impart tension fluctuations to the web as the latter travels from the "C" axis to the "I" axis. Such tension fluctuations would cause downstream register fluctuations, while going through processes like die cutting/creasing (for example at cylinders 28, 29). It is also regarded as novel to be combining the interaction of the axes "I" and "C" to create the motion at axis "A", while using either the input tension signal from the cylinder 22, or input feed rate communication, or both, to maintain tension T2 by fluctuating the average speed of the "C", "I" (and therefore "A") axes and subsequent rotary axes such as the combination 28/29 to maintain controlled tension, and therefore controlled repeat length and therefore controlled image length in a subsequent downstream image processing.

Figure 3:
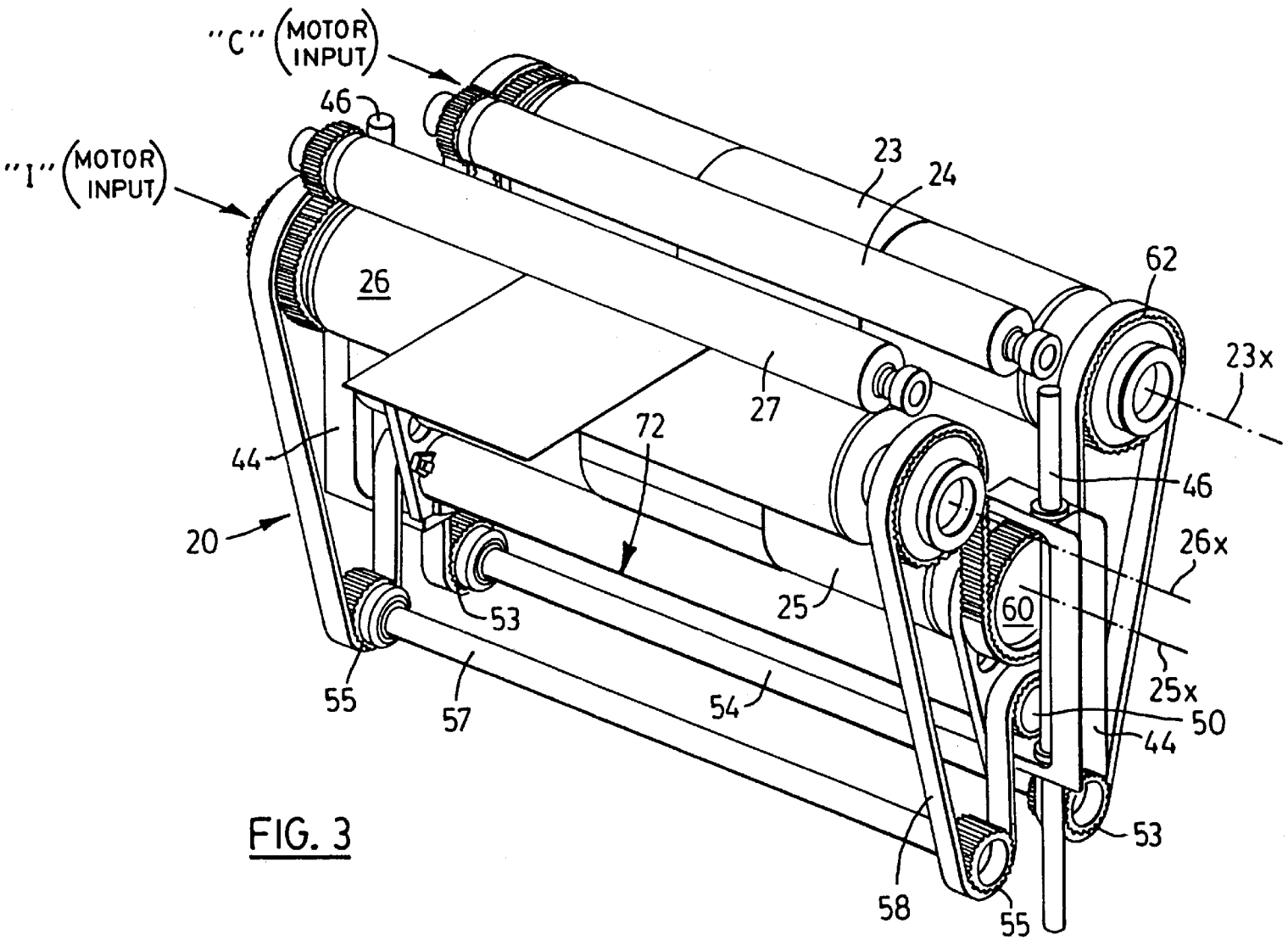
FIG. 3 is a perspective view of the cylinder module of the present invention.
Figure 4:
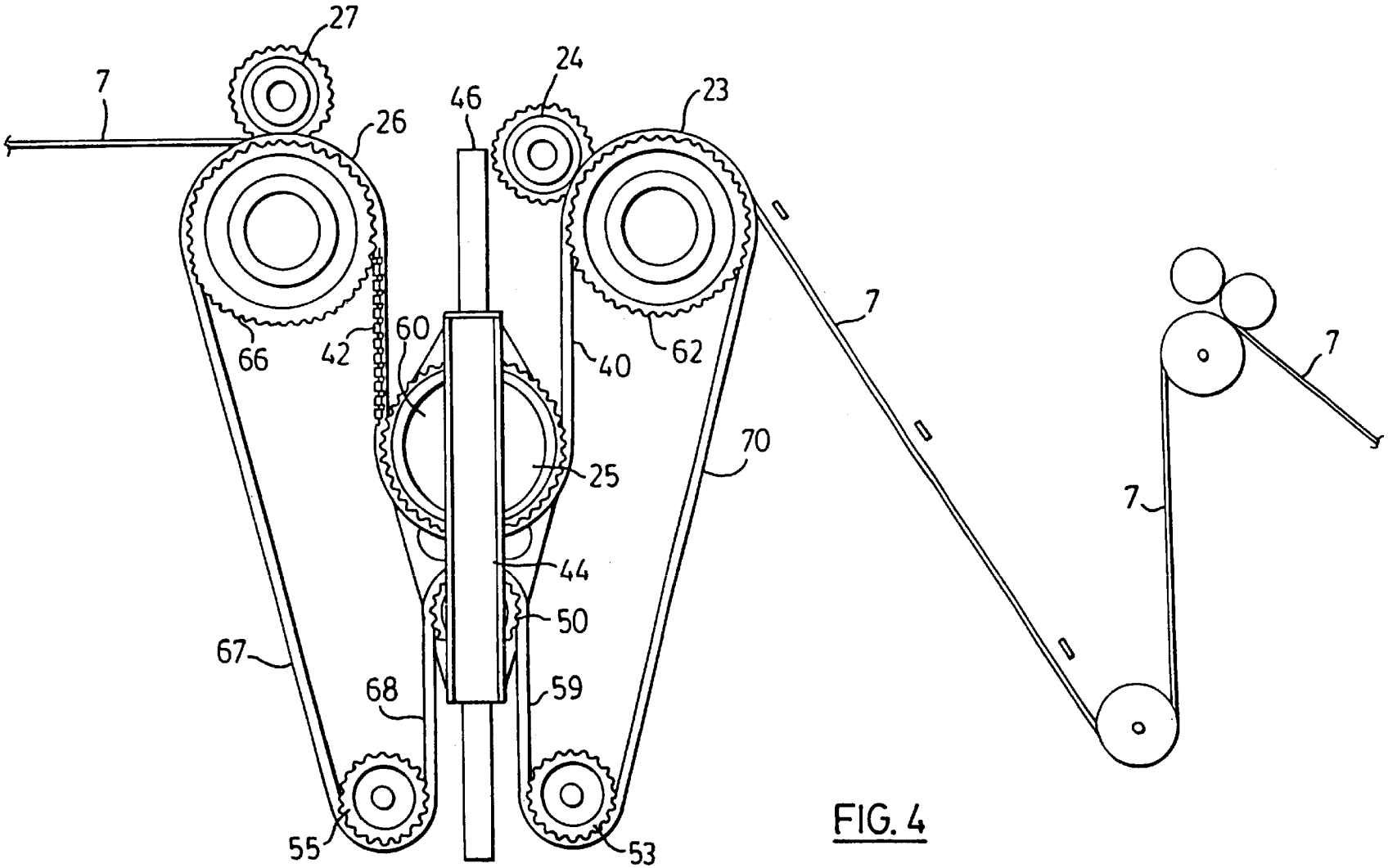
FIG. 4 is an end elevational view of the module shown in FIG. 3.

Attention is now directed to FIGS. 3 and 4 for a more detailed description of the cylinder module. It should be pointed out firstly that the structure shown in FIGS. 3 and 4 does not include frame members to which the various cylinders rollers and tubes are mounted for rotation. The frame is omitted in order to avoid cluttering the drawing. It may be considered that the broken line box 22 in FIG. 2 schematically identifies the frame of the module. Utilizing the terminology employed in the subsequent claims, we may regard the module 20 as including first main cylinder 23 mounted on the frame for rotation about a first axis 23*x* which is fixed with respect to the frame, along with a first nip cylinder 24 which cooperates with the first main cylinder 23 to form a first nip to grip the web. Also provided is a first motor drive and control system therefor (23*a* in FIG. 2) which is adapted to drive the first main cylinder 23 in a substantially continuous manner.

The module further incorporates a second main cylinder 26 mounted on the frame for rotation about a second axis 26*x* fixed with respect to the frame, the second axis 26*x* being substantially parallel with the first axis 23*x*, and both axes preferably being substantially horizontal when the module is in operation. A second nip cylinder 27 is provided to cooperate with the second main cylinder 26, to form a second nip to grip the web. A second motor drive system incorporating a second controller (26*a* in FIG. 2), is adapted to drive the second main cylinder 26 in a substantially intermittent or profiled manner.

The module further incorporates a third main cylinder (25 in FIG. 2) mounted for constrained rotation about a third axis 25*x*. The third axis 25*x* is and remains substantially parallel with the first and second axes 23*x* and 26*x* while undergoing movement in a direction perpendicular to the first and second axes.

As can be seen, the web 7 passes partially around the periphery of the first cylinder 23 and through the first nip (roller 24), thence to and partially around the periphery of the third cylinder 25, thence to and partially around the periphery of the second cylinder 26 and through the second nip (nip roller 27). The cylinders are disposed such that the web span 40 from the third cylinder 25 to the first cylinder 23 is substantially parallel to the web span 42 from the third cylinder 25 to the second cylinder 26.

Also provided, to be explained in detail below, is an endless belt means associated with each end of the third cylinder 25, which ensures that the third cylinder 25, from moment to moment, automatically takes up an axis location and a rotational position which substantially maintains controlled web stress as the web passes through the cylinders.

More particularly, the above-mentioned endless belt means includes a carriage 44 at either end of the third cylinder 25, the third cylinder being mounted to the carriages for rotation. Further, each carriage has a guideway shown as a cylindrical bar 46. The bar 46 prompts the respective carriage to undergo substantially rectilinear movement along a pathway which generally bisects the span or gap between the first and second cylinders 23, 26, although it is expected that, once the endless belt (described below) is in position and taut, the carriages will be maintained in a central position automatically.

Each carriage 44 supports a first toothed wheel 50 for rotation adjacent to and linked to the third cylinder 25. Thus the two first toothed wheels undergo simultaneous rotation.

Further, the frame supports, at opposite ends of the cylinders, two second toothed wheels 55, 55 for rotation on one side of the pathway defined by the bar 46, and two third toothed wheels 53, 53 for rotation on the other side of the pathway. The two third toothed wheels 53, 53 being locked together by a pipe 54 for simultaneous rotation, while the two second toothed wheels 55 are likewise locked together by a pipe 57 for simultaneous rotation.

The first cylinder 23, the second cylinder 26 and the third cylinder 25 all have, at either end, fourth, fifth and sixth pairs of coaxial toothed wheels fixed to the respective cylinder, as identified by numerals 62, 66 and 60, respectively.

At each end of the cylinders there is provided an endless toothed belt 58 (with teeth on both sides) entrained around the fourth toothed wheel 62 of the first cylinder 23, thence along a first path (identical to path 40 in FIG. 4) to and around the toothed wheel 60 of the third cylinder 25, thence along a second path (identical to path 42 seen in FIG. 4) to and around the toothed wheel 66 of the second cylinder 26, the first and second paths 40, 42 being parallel. The endless toothed belt is then directed along a third path 67 to and around the second toothed wheel 55 (see FIG. 4), thence along a fourth path 68 to and around the first toothed wheel 50 (on the respective carriage), thence along a fifth path 59 to and around the third toothed wheel 53, the fourth and fifth paths 68, 59 being substantially parallel to each other and to the first and second paths 40, 42. The toothed belt then passes along a sixth path 70, which returns it to the toothed wheel 62 of the first cylinder 23.

The two first toothed wheels 50 are locked rotationally together by virtue of being fixed to either end of a first elongate member 72, typically a pipe.

Also, the two second toothed wheels and the two third toothed wheels, respectively, are locked rotationally together by virtue of being fixed to either end of respective second and third elongate members 57, 54.

It will thus be seen that there has been provided a system in which an internal "module" can be defined, the module involving an absolute minimum of carriage inertia (the carriages at either end act principally to "tie" the cylinders 25 and 50 together), and cylinders (23 and 26) which have their own separate drive motors. Moreover, the "control" operates from within the module, rather than being imposed from outside the module (as in Gaskell and Singh). Thus, the system controlling the cylinder 23 does so in response to information provided from upstream, for example the tension T1 in the web after it leaves the cylinder 21 and/or, for example, the short term rate of printed image flow into the module. Likewise, the system controlling the cylinder 26 does so at least partly in response to information provided from upstream and downstream, along with the capability of monitoring the position of the cylinder 25. If the cylinder 25 approaches one of its limits, either the control system of the cylinder 26 can call for an increase or decrease in the average downstream velocity, or the latter is directed from within the modular controllers, in order to compensate.

While one embodiment of this invention has been described hereinabove and illustrated in the accompanying drawings, it will be evident to those skilled in the art that changes and modifications may be made therein without departing from the essence of this invention, as set forth in the appended claims.

The embodiments of the invention in which an exclusive property or privilege is claimed are defined as follows:

1. For use in an apparatus for handling web, a cylinder module providing for the accumulation and de-accumulation of web at a controlled web strain and minimal inertia, the module comprising:

a frame, a first main cylinder mounted on the frame for rotation about a first axis fixed with respect to the frame, a first nip cylinder cooperating with the first main cylinder to form a first nip to grip the web, a first motor and controller adapted to drive the first main cylinder in a substantially continuous manner, a second main cylinder mounted on the frame for rotation about a second axis fixed with respect to the frame, the second axis being substantially parallel with the first axis, a second nip cylinder cooperating with the second main cylinder to form a second nip to grip the web, a second motor and controller adapted to drive the second main cylinder in a substantially non-uniform manner, a third main cylinder mounted for constrained rotation about a third axis which is and remains parallel with the first and second axes while undergoing movement in a direction perpendicular to said first and second axes, whereby the web can pass partially around the periphery of the first cylinder and through the first nip, thence to and partially around the periphery of the third cylinder, thence to and partially around the periphery of the second cylinder and through the second nip, the cylinders being disposed such that there is a straight web span from the third to the first cylinder which is substantially parallel to a straight web span from the third to the second cylinder, and endless belt means associated with each end of the third cylinder for ensuring that the third cylinder, from moment to moment, automatically takes up an axial location and a rotational position which substantially control the web stress as it passes through the cylinders.

2. The module claimed in claim 1, in which said endless belt means comprises:

a carriage at either end of the third cylinder to which said third cylinder is mounted for rotation, and for each carriage a guideway means ensuring that the carriage undergoes substantially rectilinear movement along a pathway which generally bisects the span between the first and second cylinders, each carriage supporting a first toothed wheel for rotation adjacent the third cylinder, the two first toothed wheels being locked together for simultaneous rotation, and linked to the respective third cylinder through the respective carriage;

the frame supporting, at opposed ends of the cylinders, two second toothed wheels for rotation on one side of the pathway and two third toothed wheels for rotation on the other side of the pathway, the two second toothed wheels being locked together for simultaneous rotation, and the two third toothed wheels also being locked together for simultaneous rotation, the first, second and third cylinders each having, at either end, a coaxial toothed wheel fixed to the respective cylinder, and, at each end of the cylinders, an endless toothed belt entrained around the toothed wheel of the first cylinder, thence along a first path to and around the toothed wheel of the third cylinder, thence along a second path to and around the toothed wheel of the second cylinder, the first and second paths being parallel, thence along a third path to and around said second toothed wheel, thence along a fourth path to and around said first toothed wheel, thence along a fifth path to and around the third toothed wheel, the fourth and fifth path being substantially parallel to each other and to the first and second paths, thence along a sixth path which returns it to said toothed wheel of said first cylinder.

3. The module claimed in claim 1 or claim 2, in combination with a web processing apparatus from which web passes under a controlled tension to said first cylinder, said first cylinder controlling the tension.

4. The module claimed in claim 1 or claim 2, in combination with a web processing apparatus from which web passes at a predetermined feed rate to said first cylinder, said first cylinder controlling said feed rate.

5. A method of handling web, utilizing a cylinder module providing for the accumulation and de-accumulation of web at controlled web strain and minimal inertia, the module comprising:

a frame, a first main cylinder mounted on the frame for rotation about a first axis fixed with respect to the frame, a first nip cylinder cooperating with the first main cylinder to form a first nip to grip the web, a first motor and controller adapted to drive the first main cylinder in a substantially continuous manner, a second main cylinder mounted on the frame for rotation about a second axis fixed with respect to the frame, the second axis being substantially parallel with the first axis, a second nip cylinder cooperating with the second main cylinder to form a second nip to grip the web, a second motor and controller adapted to drive the second main cylinder in a substantially intermittent manner, a third main cylinder mounted for rotation about a third axis which is and remains parallel with the first and second axes while undergoing movement in a direction perpendicular to said first and second axes, said method comprising the steps:

passing the web partially around the periphery of the first cylinder and through the first nip, thence to and partially around the periphery of the third cylinder, thence to and partially around the periphery of the second cylinder and through the second nip, the cylinders being disposed such that the web span from the third to the first cylinder is substantially parallel to the web span from the third to the second cylinder, utilizing endless belt means associated with each end of the third cylinder for ensuring that the third cylinder, from moment to moment, automatically takes up an axis location and a rotational position which substantially relieve the web of stress as it passes through the cylinders, said endless belt means comprising:

a carriage at either end of the third cylinder to which said third cylinder is mounted for rotation, and for each carriage a guideway means ensuring that the carriage undergoes substantially rectilinear movement along a pathway which generally bisects the span between the first and second cylinders, each carriage supporting a first toothed wheel for rotation adjacent the third cylinder, the two first toothed wheels being locked together for simultaneous rotation, the frame supporting, at opposed ends of the cylinders, two second toothed wheels for rotation on one side of the pathway and two third toothed wheels for rotation on the other side of the pathway, the two second toothed wheels being locked together for simultaneous rotation, and the two third toothed wheels also being locked together for simultaneous rotation, the first, second and third cylinders each having, at either end, a coaxial toothed wheel fixed to the respective cylinder, and, at each end of the cylinders, an endless toothed belt;

the method further comprising: entraining said endless toothed belt around the toothed wheel of the first cylinder, thence along a first path to and around the toothed wheel of the third cylinder, thence along a second path to and around the toothed wheel of the second cylinder, the first and second paths being parallel, thence along a third path to and around said second toothed wheel, thence along a fourth path to and around said first toothed wheel, thence along a fifth path to and around the third toothed wheel, the fourth and fifth path being substantially parallel to each other and to the first and second paths, thence along a sixth path which returns it to said toothed wheel of said first cylinder.

* * * * *